US012011090B2

(12) United States Patent
Schwind

(10) Patent No.: US 12,011,090 B2
(45) Date of Patent: Jun. 18, 2024

(54) MULTI-LAYERED LIGHTED PAINTING AND ETCHING ASSEMBLY

(71) Applicant: John Schwind, Berlin, NH (US)

(72) Inventor: John Schwind, Berlin, NH (US)

( * ) Notice: Subject to any disclaimer, the term of this patent is extended or adjusted under 35 U.S.C. 154(b) by 0 days.

(21) Appl. No.: 17/980,182

(22) Filed: Nov. 3, 2022

(65) Prior Publication Data

US 2024/0148143 A1 May 9, 2024

(51) Int. Cl.
*A47B 97/04* (2006.01)

(52) U.S. Cl.
CPC ..... *A47B 97/04* (2013.01)

(58) Field of Classification Search
CPC ..... A47B 97/04
See application file for complete search history.

(56) References Cited

U.S. PATENT DOCUMENTS 3,231,230 A * 1/1966 Mueller ..... F16M 11/28 248/476
4,643,384 A * 2/1987 Guerin ..... A47B 97/04 248/452
5,555,654 A * 9/1996 Hermann ..... G09F 13/0413 362/604
5,899,012 A * 5/1999 Crum ..... G09F 13/04 40/716
6,174,065 B1 * 1/2001 Schurch ..... G09F 13/08 362/559
6,471,174 B2 * 10/2002 Turner ..... A47B 97/04 248/446
2007/0040089 A1 * 2/2007 Shiff ..... A47B 97/04 248/455

(Continued)

FOREIGN PATENT DOCUMENTS

CN 109124116 A * 1/2019
DE 102013012093 A1 * 1/2015 ..... A47B 97/08
KR 20110048662 A * 5/2011

OTHER PUBLICATIONS

"Layered Glass Art" online posting on instructables.com, https://www.instructables.com/Layered-glass-art/ (Year: 2021).*

(Continued)

*Primary Examiner* — Terrell L McKinnon
*Assistant Examiner* — Ding Y Tan
(74) *Attorney, Agent, or Firm* — Dale J. Ream

(57) ABSTRACT

A multi-layered lighted painting and etching easel assembly includes an easel portion having length-adjustable frame legs extending and being wedged between a floor and ceiling. The easel portion includes lower support blocks for receiving an edge of a transparent easel workpiece. The easel portion includes lower retaining blocks configured to receive an edge of the easel workpiece and is slidably and lockingly movable in and out of the lower notch. The assembly includes a holder portion displaced from the easel portion that includes a holding plate that defines a window. The holding plate may include a bottom face having support rods extending forwardly for supporting the workpiece(s). The easel assembly includes a display portion situated rearwardly of the holder portion, and that includes a light panel mounted to a rear of the holding plate that is operable to direct light toward the window and through the workpieces when energized.

10 Claims, 8 Drawing Sheets

(56) References Cited

U.S. PATENT DOCUMENTS

| | | | | |
|---|---|---|---|---|
| 2020/0320912 | A1* | 10/2020 | Schneider | G09F 13/18 |
| 2023/0225511 | A1* | 7/2023 | Thompson | A47B 91/02 248/448 |

OTHER PUBLICATIONS

Michael Frank Peterson facebook photo posting dated May 21, 2022 (Year: 2022).*
Neomounts by Newstar instruction manual and https://www.neomounts.com/ceiling/ceiling-to-floor-mounts/fpma-cf200silver-neomounts-ceiling-to-floor-mount/ (Year: 2019).*
"Painting Easel" on Viewer Project by Chad Eichler (Year: 2010).*
Paul Anthony online article "Frame-And-Panel Finesse: Looks And Longevity Are In The Details" dated Apr. 8, 2014, published by Woodcraft magazine (Year: 2014).*
3d layer decorative art display for Iris flower etched glass with wood stand online page, published on custommade.com archive.org dated: Oct. 25, 2020 (Year: 2020).*
"How to Make an Easel" article on wikihow.com co-authored by wikiHow staff, updated date: Jul. 24, 2020 (Year: 2020).*
Jazza 3D Multiverse box youtube video dated Feb. 26, 2022 (Year: 2022).*

* cited by examiner

MULTI-LAYERED LIGHTED PAINTING AND ETCHING ASSEMBLY

BACKGROUND OF THE INVENTION

This application relates to easel devices and. more particularly. To a new easel assembly for securing and displaying a glass etching and painting workpiece.

Creating works of art are much more varied today than just brushing paint on a canvas or sketching with a pen or pencil. For instance, artists may desire to etch a design onto a piece of stone, metal, glass, or the like. Etching refers to applying a sketch to a metal or glass plate as opposed to a canvas and may be accomplished using an etching tool rather than a brush. It is difficult to etch a glass were metal plate, however, unless the plate is held securely while the artist etches a design. A traditional easel, unfortunately, is not typically constructed in a manner capable of holding a metal plate during an etching event. In addition, an artist may desire to both etch and paint using multiple transparent workpieces so as to display a multi-layer artistic design that may be illuminated.

Various devices have been proposed in the prior art relates to easel devices designed for canvases and painting. Existing devices are not designed for etching and thus do not have a way to secure an etching plate. Nor do they provide means for displaying multiple layers of etched and painted transparent sheets. In addition, existing easels are not equipped to illuminate a plurality of glass or transparent sheets that has been painted and etched.

Therefore, it would be desirable to have a multi-layered lighted painting and etching easel assembly having a structure for securing a glass or transparent sheet in a position that is convenient for an artist to paint and etch a design upon a surface of the glass. Further, it would be desirable to have a multi-layered lighted painting and etching easel assembly that may include an easel portion having a pair of length-adjustable legs configured to selectively wedge between floor and ceiling surfaces such that the weight of a transparent plate does not upset or dislodge the easel. In addition, it would be desirable to have a multi-layered lighted painting and etching easel assembly that includes a display portion operative to couple multiple layers of transparent sheets in-line with a light panel.

SUMMARY OF THE INVENTION

A multi-layered lighted painting and etching easel assembly according to the present invention includes an easel portion that includes a pair of frame legs each having a proximal end adjacent a floor surface and a distal end opposite the proximal end and adjacent a ceiling surface, each frame leg having an elongate and linear configuration that is length adjustable so as to be intentionally wedged between the floor surface and the ceiling surface. The easel portion includes a pair of lower support blocks selectively mounted to the pair of frame legs, respectively, at a position upwardly displaced from the distal ends, respectively, and each defining a lower notch having a U-shaped configuration for receiving a lower edge of an easel workpiece. Further, the easel portion may include a pair of lower retaining blocks each having opposed end walls and defining a slot extending between the end walls that is configured to receive the lower edge of the easel workpiece and is slidably movable along the lower edge between a locked configuration nested in a respective lower notch and an unlocked configuration displaced from the respective lower notch.

The easel assembly may include a holder portion displaced from the easel portion that includes a holding plate having a planar configuration and a geometric area that is concentrically larger than a geometric area of the easel workpiece, that holding plate defines a window having a geometric area that is complementary to the geometric area of the easel workpiece. The holding plate may include a bottom face portion having a plurality of support rods spaced apart from one another and extending forwardly, the plurality of support rods configured to support the easel workpiece thereon.

The easel assembly may also include a display portion situated rearwardly of the holder portion, and that includes a light panel mounted to a rear of the holding plate and that is operable to direct light toward the window when energized.

Therefore, a general object of this invention is to provide a multi-layered lighted painting and etching easel assembly for the etching, painting, and display of a multi-layer glass artistic workpiece.

Another object of this invention is to provide a multi-layered lighted painting and etching easel assembly, as aforesaid, having an easel portion that is secured floor-to-ceiling and configured to hold a glass or transparent workpiece for painting and etching.

Still another object of this invention is to provide a multi-layered lighted painting and etching easel assembly, as aforesaid, having a display portion that is configured to hold a plurality of transparent workpieces in stacked proximity to a light panel for simultaneous illumination thereby.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
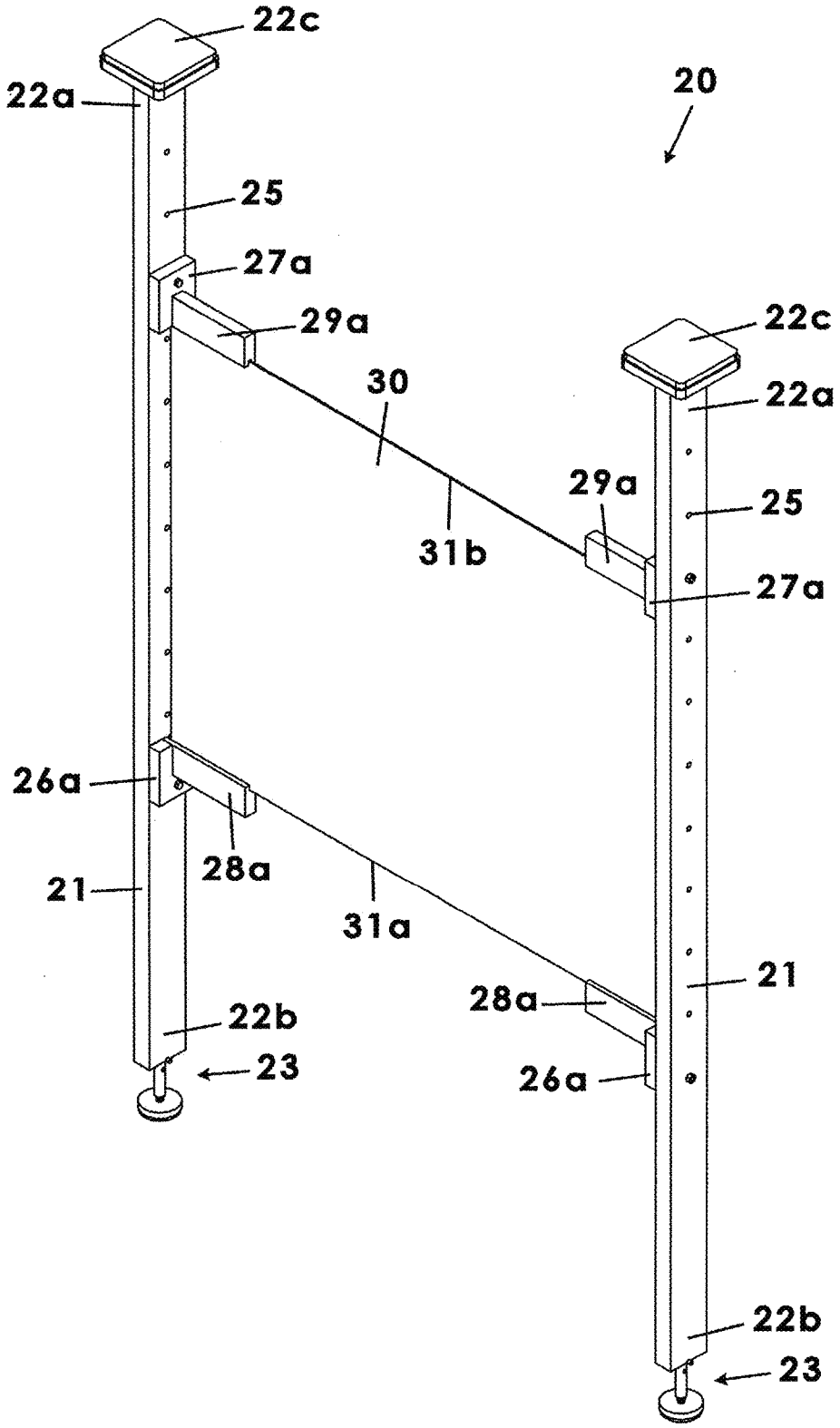
FIG. 1 is a perspective view of an easel portion of the multi-layered lighted painting and etching easel assembly according to the present invention, illustrated with an easel workpiece in a locked configuration.

A multi-layered lighted painting and etching easel assembly according to a preferred embodiment of the present invention will now be described with reference to FIGS. 1 to 8*b* of the accompanying drawings. The multi-layered lighted painting and etching easel assembly (also referred to, in short, as the "multi-layered easel assembly") may include an easel portion 20, a holder portion 30, and a display portion 40.

The easel portion 20 may include a pair of legs 21 having identical constructions and having linear and elongate configurations that, in an embodiment, are intended to extend tightly between a floor surface 12 and a ceiling surface 13 of a residence or commercial structure. More particularly each leg 21 has a proximal end 22*a* intended to be positioned adjacent the floor surface and a distal end 22*b* opposite the proximal end 22*a* intended to be positioned adjacent the ceiling surface. Further, each leg 21 may be length adjustable such that each leg 21 may be lengthened and tightened until the leg 21 becomes wedged tightly between the floor and ceiling surfaces 12, 13. It is understood that this wedged configuration enables the easel portion 22 to hold a plurality of easel workpieces 30 which may be constructed of glass or a similar material that may be heavy and may cause a traditional easel to become unstable or even fall over as will be described in more detail later.

One means for making the pair of legs 21 length-adjustable are a pair of furniture leveler fasteners 23, each furniture leveler fastener having a pad portion 23*a* intended to bear against the floor surface and a leg portion 23*b* extending perpendicularly and away from the associated pad portion 23*a*. Preferably, each leg portion 23*b* may be threadably coupled to a distal end 22*b* of a respective leg 21 such that the furniture leveler fastener 23 may be rotated to lengthen or shorten the length-adjustable leg 21. In an embodiment, each leg 21 may have a solid construction or, at least, a closed bottom wall into which a respective furniture leveler fastener 23 may be threadably inserted.

Figure 3A:
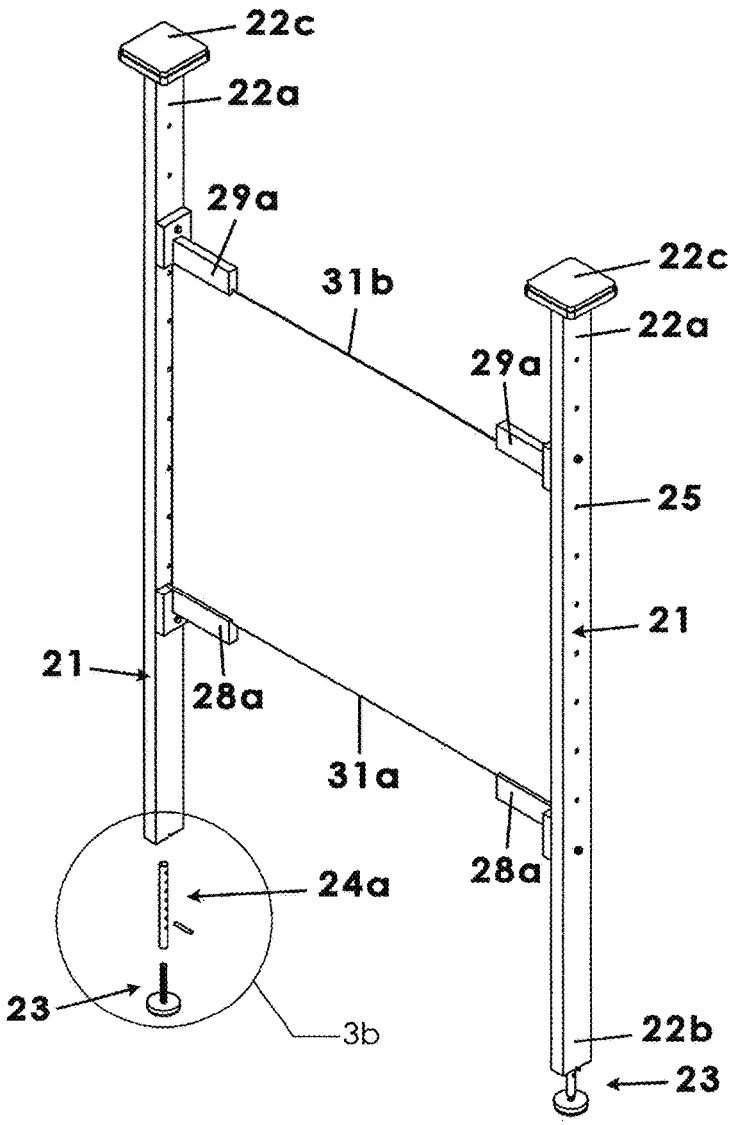
FIG. 3*a* is another perspective view of the easel portion as in FIG. 1.
Figure 3B:
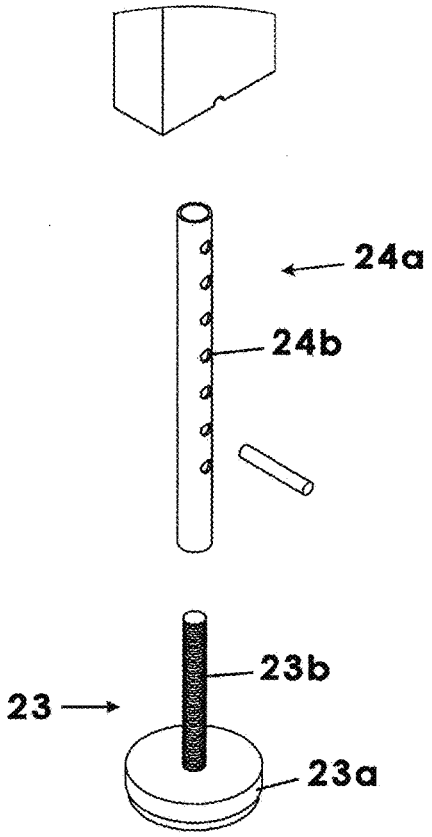
FIG. 3*b* is an isolated view on an enlarged scale taken from a portion of FIG. 3*a;*
Figure 4:
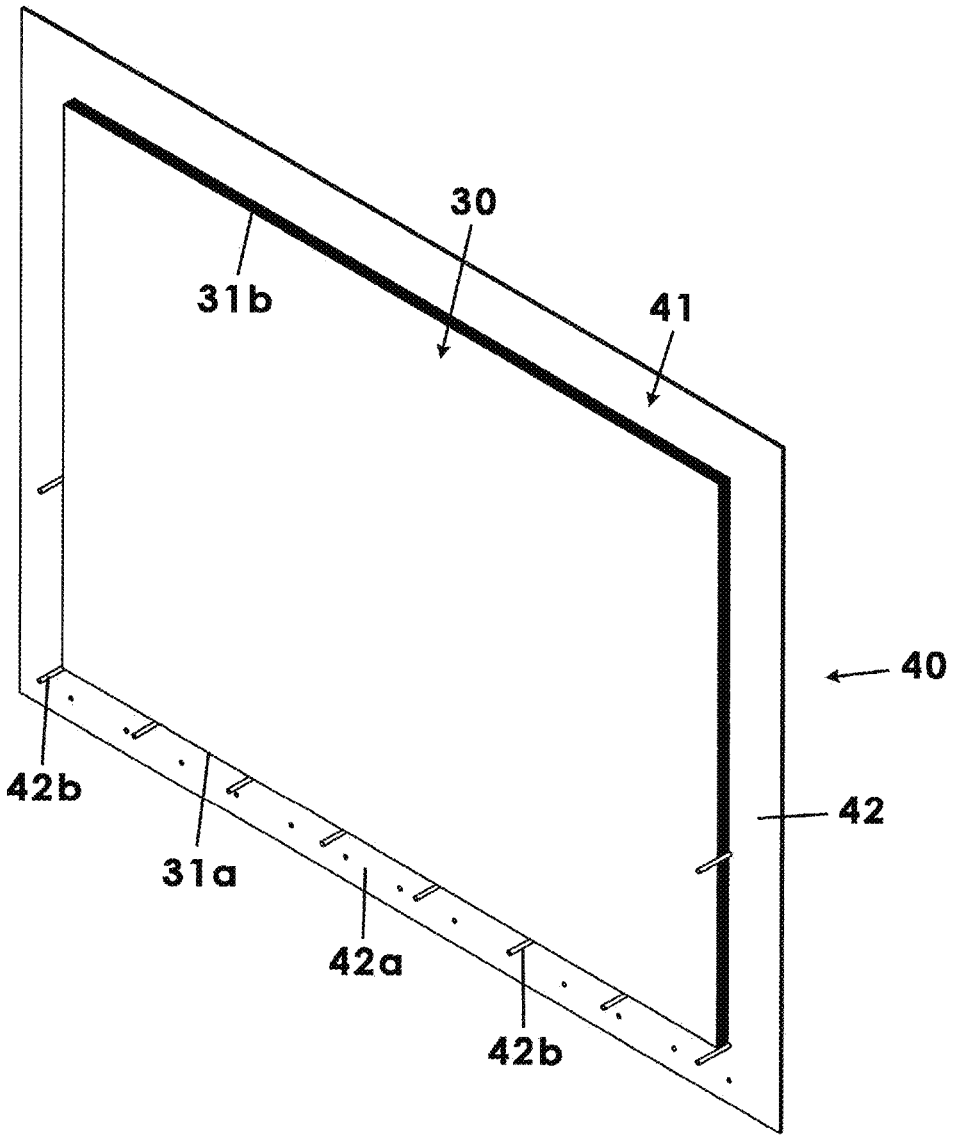
FIG. 4 is a perspective view of a holding and display portion of the multi-layered lighted painting and etching easel assembly according to the present invention.
Figure 5:
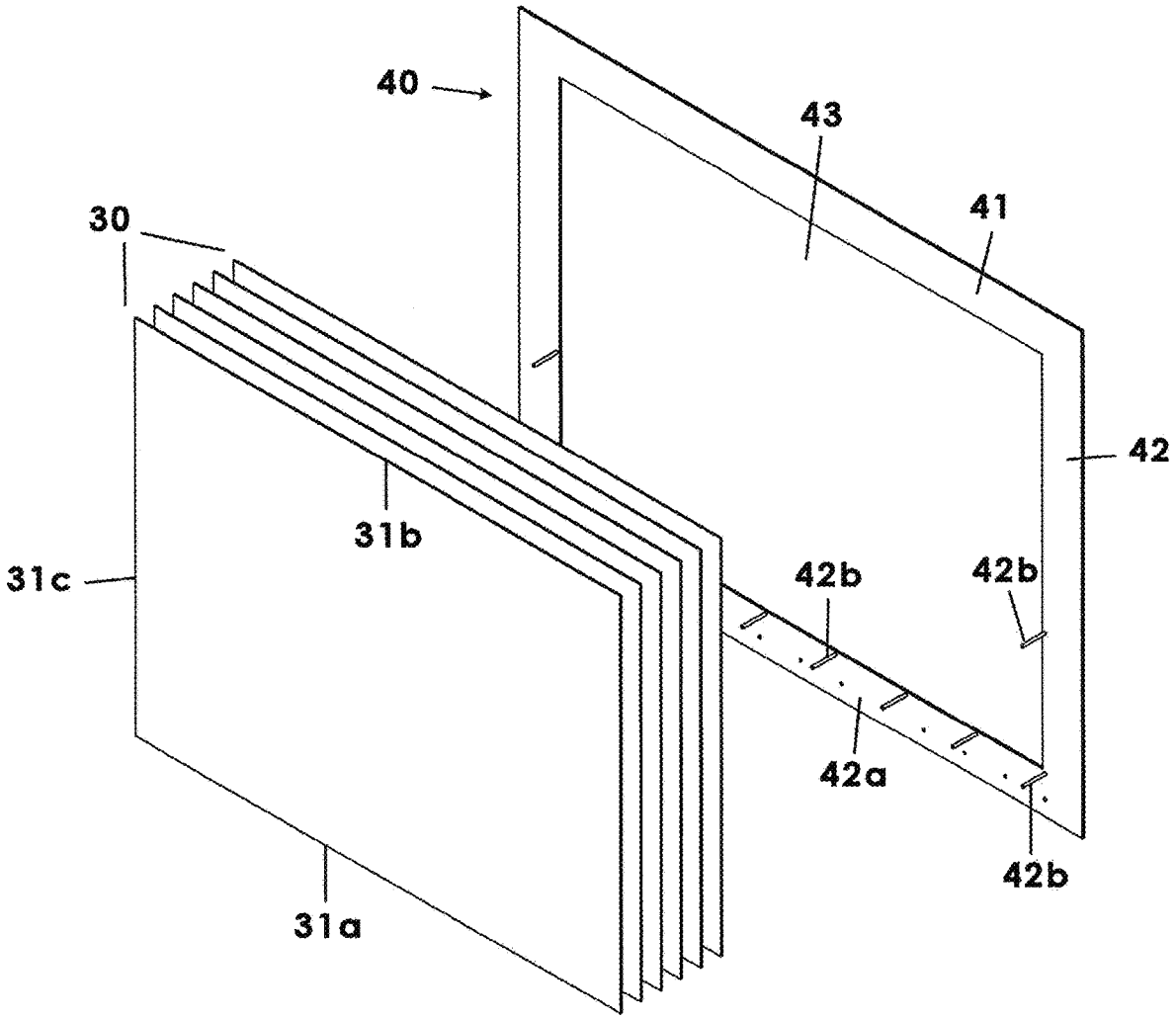
FIG. 5 is an exploded view of the holding and display portion of the etching easel assembly as in FIG. 4.
Figure 6:
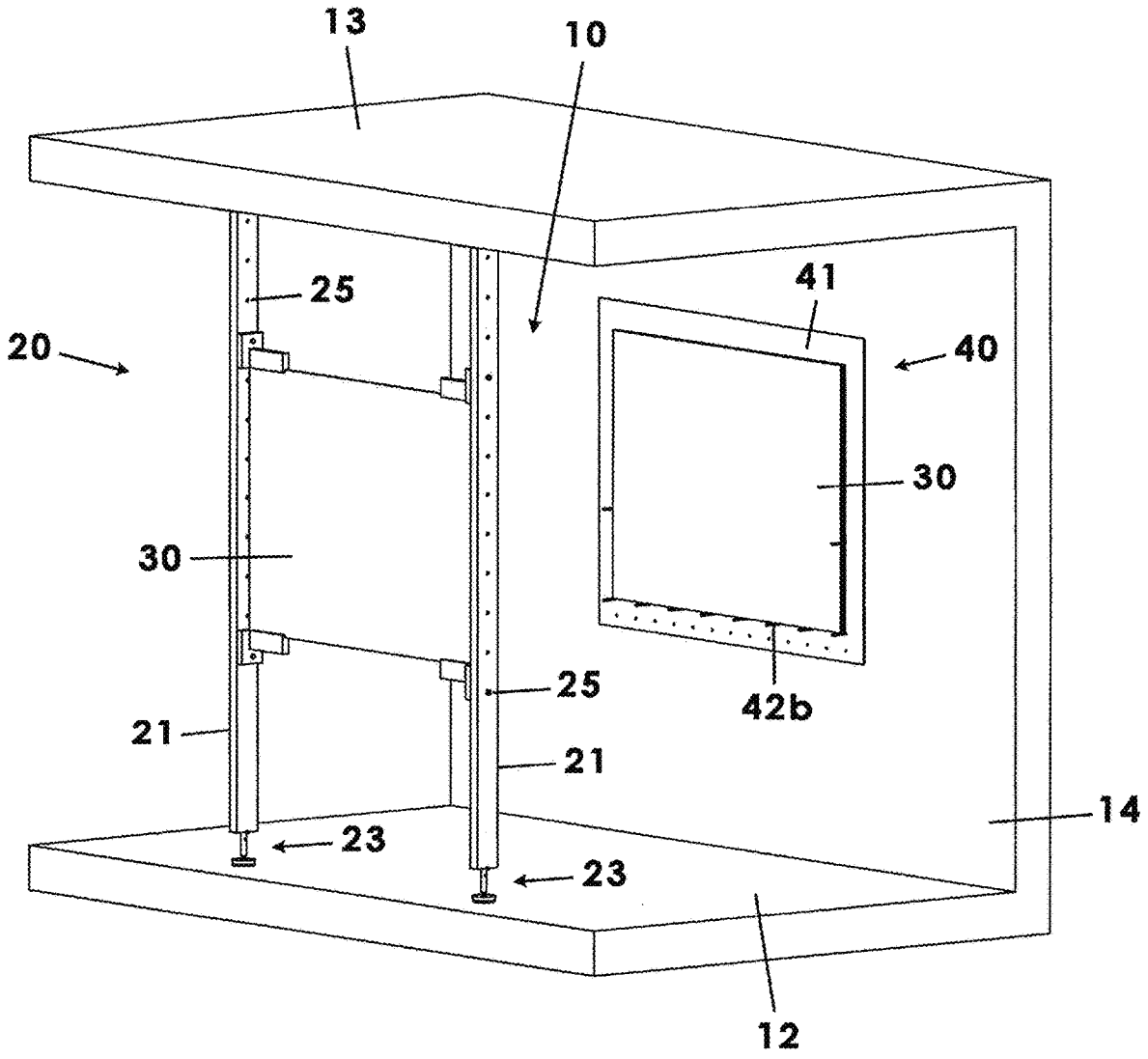
FIG. 6 is a perspective view of the entire multi-layered lighted painting and etching easel assembly according to a preferred embodiment of the present invention, illustrated installed in a residential or commercial structure having a floor surface and a ceiling surface and a wall extending between the floor and ceiling surfaces.
Figure 7:
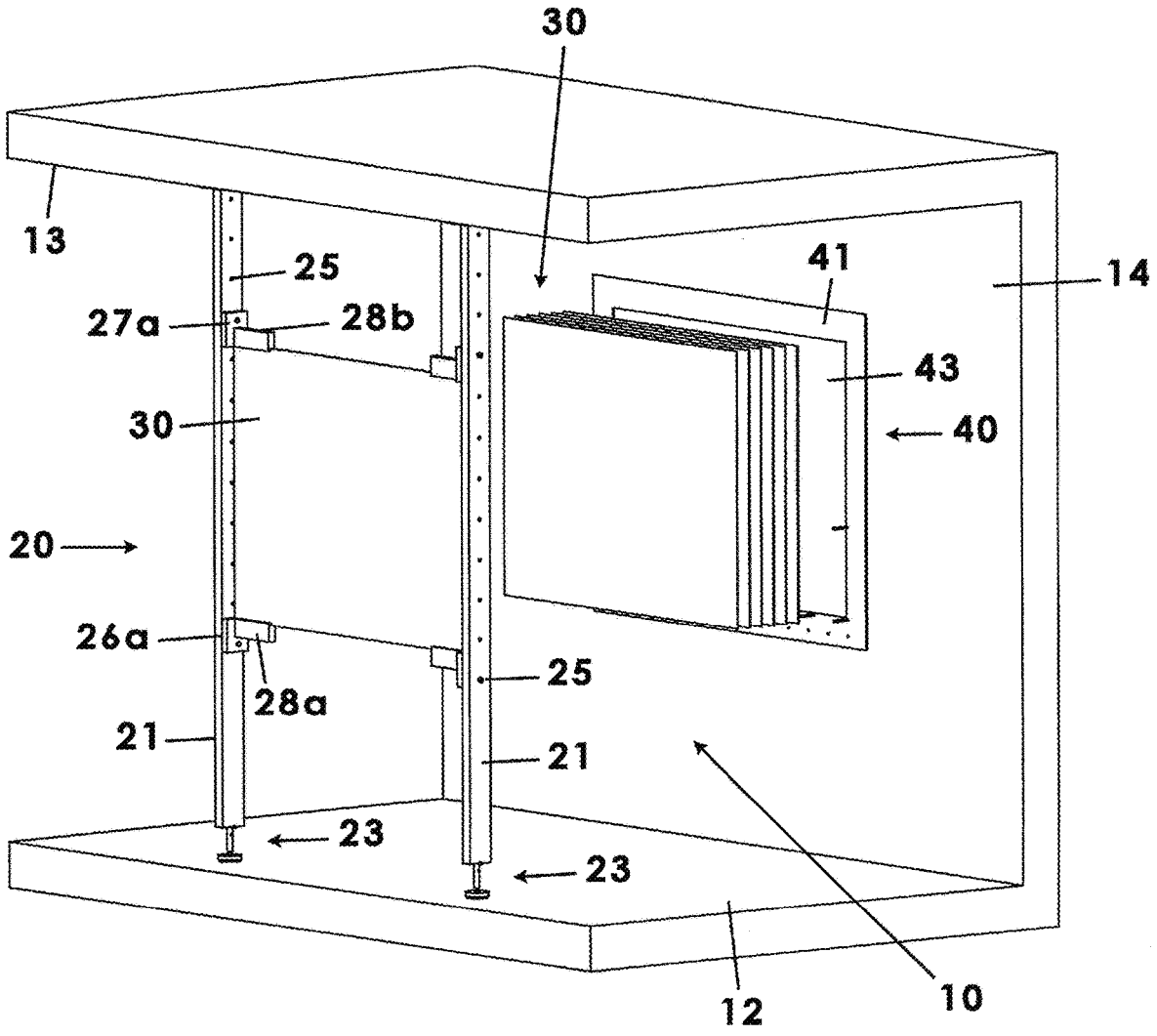
FIG. 7 is another perspective view of the entire multi-layered lighted painting and etching easel assembly as in FIG. 6, illustrated with the plurality of gathered easel workpieces in an exploded configuration.

In an embodiment, each leg 21 may define a hollow interior area and may include an additional means for length adjustment. As shown in FIG. 3*b*, each leg 21 may include an adjustment tube 24*a* that defines a plurality of apertures 24*b* spaced apart from one another between opposed ends thereof and having a pin 24*c* for adjustable insertion into a selected aperture 24*b*. Each adjustment tube 24*a* is hollow and includes an open bottom and includes a diameter larger than the diameter of a leg portion 23*b*. Further, each adjustment tube 24*a* may include an inner surface that is threaded and complementary to the external threads characteristic of an associated leg portion 23*b*. Accordingly, each adjustment tube 24*a* may be length-adjustably and threadably coupled to a respective leg portion 23*b* whereby to give a user even more control over the length of each leg 21. It is understood that each adjustment tube 24*a* is received up inside the interior space of a respective leg 21.

With further reference to the pair of legs 21, the easel portion 20 may include a pair of contact pads 22*c* mounted to the proximal ends 22*a*, respectively, so that the proximal ends 22*a* themselves do not cause damage to the ceiling surface 13.

The mounting of an easel workpiece 30 between the pair of legs 21 of the easel portion 20 will now be described in more detail. Each leg 21 defines a plurality of size adjustment holes 25, each adjustment hole 25 being linearly spaced apart along a linear extent of an inner surface of the leg 21. The easel portion 20 includes a pair of lower support blocks 26*a* and a pair of upper support blocks 27*a*. Preferably, each lower support block 26*a* has a U-shaped configuration as a result of having an upwardly open lower notch 26*b*. Similarly, each upper support block 27*a* has an inverted-shaped configuration as a result of having a downwardly open upper notch 27*b*. It is understood that each support block may be coupled to the inner surface of a respective leg with a fastener such as a pin, rod, or bolt inserted through the respective block and respective adjustment hole 25. Accordingly, the pair of lower support blocks 26*a* will be laterally opposite one another and the pair of upper support blocks 27*a* will be laterally opposite one another, each being configured to receive a lower edge 31*a* and an upper edge 31*b* of a respective easel workpiece 30 in respective notches.

Figure 2A:
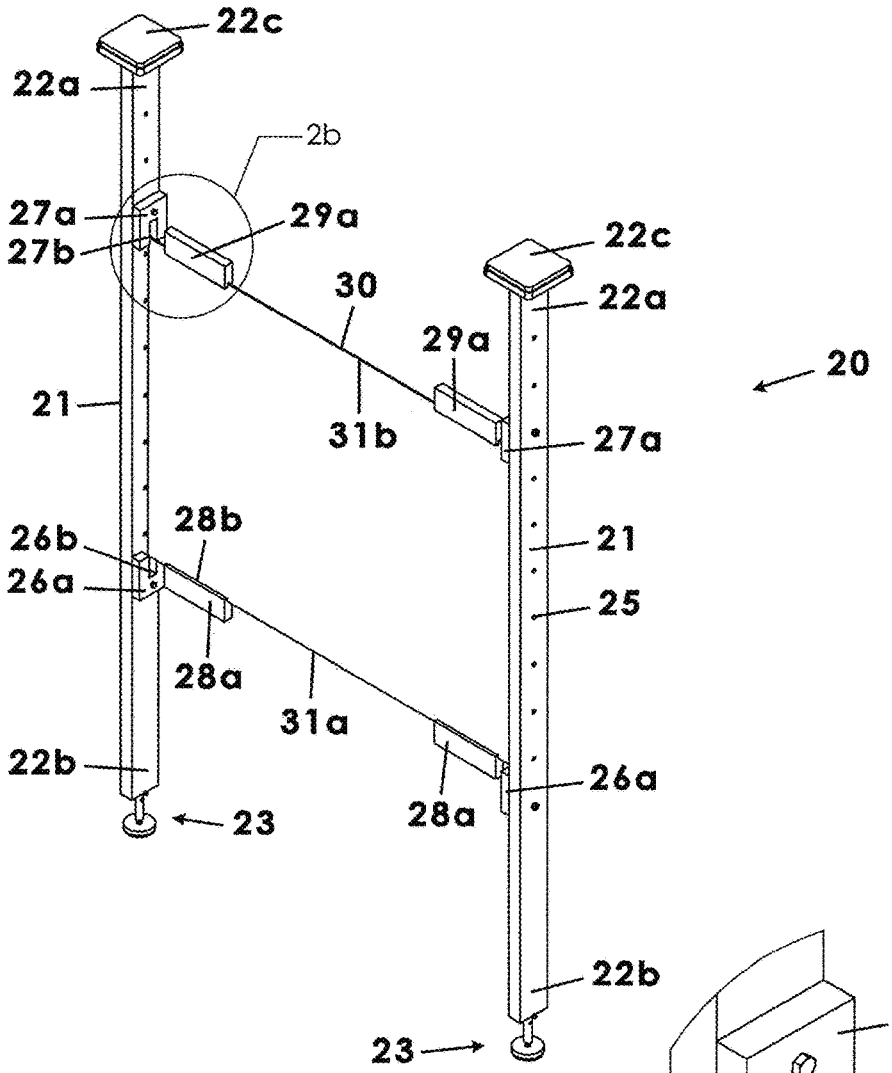
FIG. 2*a* is a perspective view of the easel portion of the easel assembly as in FIG. 1, illustrated in an unlocked configuration.
Figure 2B:
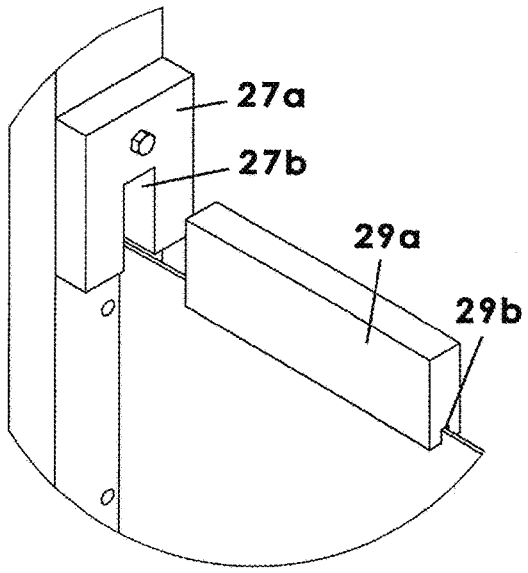
FIG. 2*b* is an isolated view on an enlarged scale taken from a portion of FIG. 2*a;*

Similarly, the easel portion 20 includes a pair of lower retaining blocks 28*a* and a pair of upper retaining blocks 29*a*. Each lower retaining block 28*a* has opposed end walls that define a slot 28*b* extending therebetween, the slot 28*b* being configured to receive the lower edge 31*a* of the easel workpiece 30. Accordingly, the lower retaining block 28*a* is slidably movable along the lower edge 31*a* between a locked configuration nested in a respective lower notch 26*b* (FIG. 1) and an unlocked configuration displaced from said respective lower notch 26*b* (FIG. 2*b*). As can be seen in FIG. 1, and easel workpiece 30 may be held securely to the pair of legs 21, respectively, when upper 31*b* and lower 31*a* edges thereof are received in respective notches and slots, respectively.

While only a single easel workpiece 30 is mounted to the easel portion 20 at a time, the multi-layered lighted painting and etching easel assembly 10 may include a plurality of easel workpieces 30, each having a lower edge 31*a* an upper edge 31*b* with opposed side edges 31*c* extending between the lower and upper edges. Preferably, each easel workpiece 30 has a generally thin and rectangular configuration and constructed of a glass, Plexiglas, or transparent material that may be both painted and etched upon as will be described later. It will be understood that easel workpieces having various dimensions may be utilized and that the support blocks may be adjusted relative to the adjustment holes, respectively.

In another aspect, the multi-layered lighted painting and etching easel assembly 10 may include a holder portion 40 that is displaced from the easel portion 20. In other words, the easel portion 20 and holder portion 40 are critical components of the multi-layered lighted painting and etching easel assembly 10 although not coupled together. More particularly, the holder portion 40 may include a holding plate 41 having a planar configuration and a geometric area that is concentrically larger than a geometric area of an easel workpiece 30. In an embodiment, the holding plate 41 may be constructed of a thin metal material, such as aluminum or the like. As will be described, the holding plate 41 is slightly larger than an easel workpiece 30 and is configured to support and hold a plurality of easel workpieces 30. More particularly, the holding plate 41 may include a face portion 42 that defines a window 43 having a configuration that is identical or substantially identical to a configuration of an easel workpiece so that light from a light panel 52 may shine through the window and plurality of easel workpieces, as will be described in more detail later. Further, the face portion 42 includes a bottom face portion 42*a* having a plurality of support rods 42*b* spaced apart from one another and extending forwardly. Together, the plurality of support rods 42*b* are configured to support an individual easel workpiece thereon or a plurality of easel workpieces 30 thereon. The holding plate 41 and light/display panel 52 may be mounted on a wall 14 of the structure.

Figure 8A:
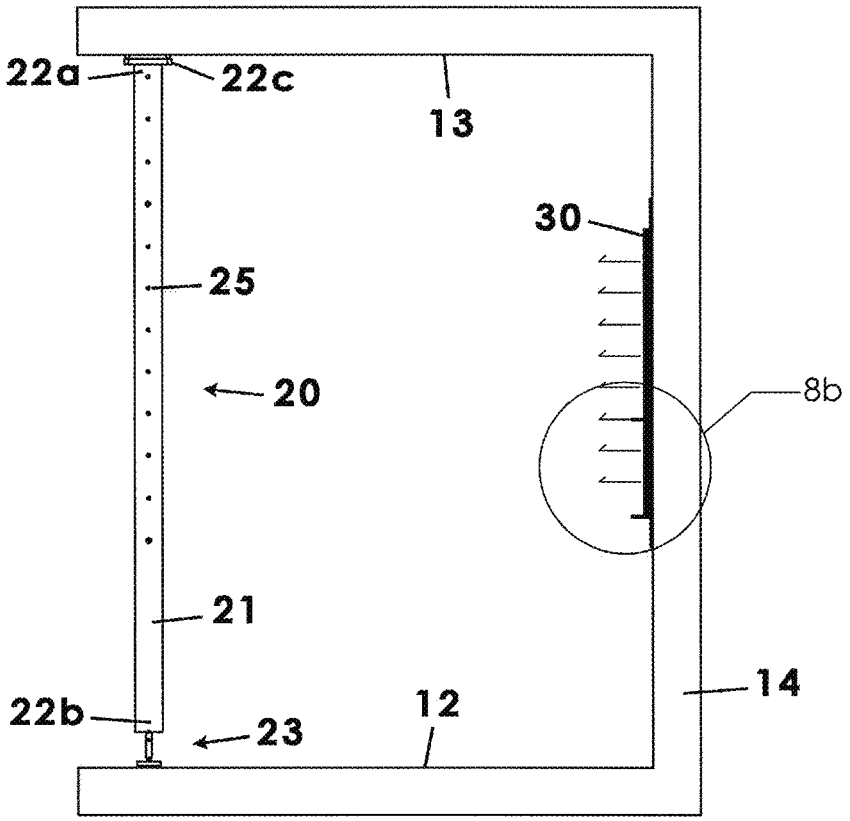
FIG. 8*a* is a side view of the entire easel assembly as in FIG. 6, schematically illustrating the forward illumination being transmitted by the lighting assembly when energized.
Figure 8B:
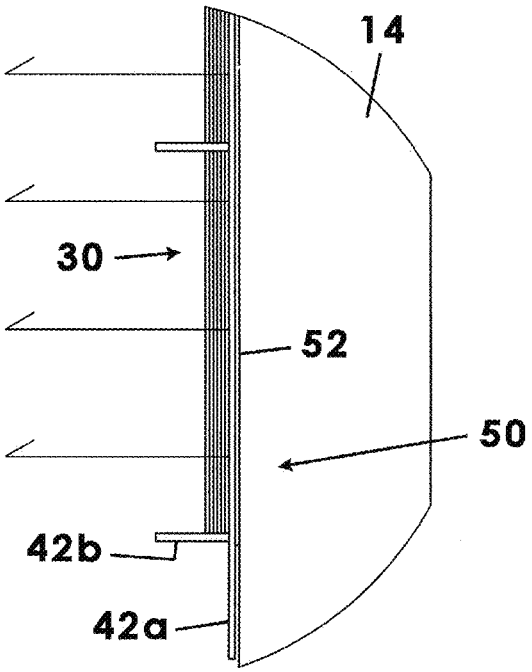
FIG. 8*b* is an isolated view on an enlarged scale taken from a portion of FIG. 8*a*.

In another critical aspect, the multi-layered lighted painting and etching easel assembly 10 includes a display portion 50 that is mounted rearwardly of the holding plate 41 and a single or entire plurality of easel workpieces 30. Preferably, the display portion 50 includes a display panel 52 mounted to a rear surface of the holding plate 41, the display panel 52 having a plurality of LEDs operable to direct light in the direction of the window 43 when energized as shown in FIG. 8*b*. It is understood, of course, that the light panel 52 may be energized by an electrical connection to AC power or a battery.

The structure of the multi-layered lighted painting and etching easel assembly 10 is preferably utilized according to a method of use as will be described below in detail. In a preferred embodiment of the present invention, a plurality of easel workpieces 30 will be displayed together; in other words, multiple transparent sheets, each having been painted and etched, may be positioned adjacent one another and held on holding plate 41 of the display portion 50 and through which the LED light panel 52. Accordingly, the method of using multi-pain lighted etching easel assembly 10 described above begins by gathering a plurality of easel workpieces 30 together and positioning them upon the horizontal plane of the holding plate 41. It will be understood, that workpieces 30 prior to being painted or etched may initially be supported by the holding plate 41 and then a respective workpiece 30 may be repositioned upon the easel portion 20 and held in place so that an artist may paint or etch on it, the easel portion 20 having frame legs and support blocks, as previously described in detail. When each easel workpiece 30 has been appropriately painted and etched, it may be returned to the holding plate 41 and selectively illuminated. It should be understood by this point that each easel workpiece 30 may include only a portion of an overall multi-layered artistic rendering such that the entire artistic rendering may not be fully visible or appreciated until all of the plurality of easel workpieces 30 have been prepared upon the easel portion 20 and then repositioned and supported on the holding plate 41 adjacent workpieces. According to the preferred method, a single easel workpiece 30 is selected and then mounted to the easel portion 20 where it may be painted and etched and then moved and returned to the holding plate 41 until all of the gathered easel workpieces 30 have been respectively painted, etched, and positioned upon the holding plate 41. Then, the indicia position on the front faces of the gathered easel workpieces 30 may be fully displayed and appreciated as a multi-pain or multi-layer artistic expression by energizing the light panel 52. Further details of each component of the assembly have been previously discussed above Accordingly, multi-layered lighted painting and etching easel assembly 10 may be used most effectively in an educational environment such as a school, university, or private art studio where students may be learning and practicing painting and etching on individual transparent easel workpieces such as Plexiglas, actual glass, translucent plastic, or the like, and subsequently desire to eliminate multiple workpieces simultaneously, whereby to display the multi-layered artistic creation that they have rendered. Of course, the multi-layered lighted painting and etching easel assembly 10 may have other commercial uses whereby individual workpieces may be prepared by a professional artist using the easel portion 20 and then being displayed together with a plurality of gathered and adjacent workpieces.

It is understood that while certain forms of this invention have been illustrated and described, it is not limited thereto except insofar as such limitations are included in the following claims and allowable functional equivalents thereof.

The invention claimed is:

1. A multi-layered lighted painting and etching easel assembly, comprising:

an easel portion, comprising:

a pair of frame legs each having a proximal end adjacent a floor surface and a distal end opposite said proximal end and adjacent a ceiling surface, said each frame leg having an elongate and linear configuration that is length adjustable so as to be intentionally wedged between the floor surface and the ceiling surface;

a pair of lower support blocks selectively mounted to said pair of frame legs, respectively, at a position upwardly displaced from said distal ends, respectively, and each defining a lower notch having a U-shaped configuration for receiving a lower edge of an easel workpiece;

a pair of lower retaining blocks each having opposed end walls and defining a slot extending between said end walls that is configured to receive said lower edge of said easel workpiece and is slidably movable along said lower edge between a locked configuration nested in a respective lower notch and an unlocked configuration displaced from said respective lower notch;

a holder portion displaced from said easel portion, comprising:

a holding plate having a planar configuration and a geometric area that is concentrically larger than a geometric area of said easel workpiece that holding plate defines a window having a geometric area that is complementary to said geometric area of said easel workpiece, said holding plate including a bottom face portion having a plurality of support rods spaced apart from one another and extending forwardly, said plurality of support rods configured to support said easel workpiece thereon;

wherein said easel workpiece is one of a plurality of easel workpieces each having a planar configuration and a transparent construction, said each easel workpiece being peripherally bounded by said upper edge situated opposite said lower edge and having a pair of side edges extending between said upper and lower edges, respectively, so as to form a rectangular configuration; and a display portion situated rearwardly of said holder portion, comprising:

a light panel mounted to a rear of said holding plate and that is operable to direct light toward said window when energized;

a pair of upper support blocks selectively mounted to said pair of frame legs, respectively, at a position downwardly displaced from said proximal ends, respectively, and each defining an upper notch having an inverted U-shaped configuration for receiving an upper edge of said easel workpiece; and a pair of upper retaining blocks each having opposed end walls and defining a slot extending between said end walls thereof that is configured to receive said upper edge and is slidably movable along said upper edge of said easel workpiece between a locked configuration nested in a respective upper notch and an unlocked configuration displaced from said respective upper notch;

a plurality of furniture leveler fasteners each having a leg portion threadably mounted to said distal ends of said pair of frame legs, respectively, and a pad portion operative to bear against the floor surface, said plurality of furniture leveler fasteners being operable to lengthen or shorten said pair of furniture legs, respectively.

2. The multi-pane lighted etching easel as in claim 1, wherein:

said pair of frame legs each defines a plurality of through-bores each being spaced apart longitudinally from an adjacent through-bore and having a threaded configuration, said plurality of lower support blocks and said plurality of upper support blocks being selectively mounted to said plurality of through-bores with a fastener, whereby to receive said easel workpiece.

3. The multi-pane lighted etching easel as in claim 1, further comprising a pair of contact pads mounted to said proximal ends of said pair of frame legs, respectively, each having a foam construction.

4. The multi-pane lighted etching easel as in claim 1, wherein:

said plurality of support rods are configured to support said plurality of easel workpieces thereon; and said light panel being operable to direct light through said window and through plurality of workpieces when energized.

5. The multi-pane lighted etching easel as in claim 4, wherein said plurality of easel workpieces are constructed of Plexiglas™.

6. A method of using a multi-layered lighted painting and etching easel assembly, comprising:

gathering a plurality of easel workpieces each having a planar configuration and a transparent construction and including a lower edge having a linear configuration and an upper edge opposite and parallel to said lower edge and having a linear configuration, said each easel workpiece having a front face extending between the upper and lower edges and operative to receive indicia;

providing an easel portion positioned in a structure having a floor surface and a ceiling surface, said easel portion comprising:

a pair of frame legs each having a proximal end adjacent a floor surface and a distal end opposite said proximal end and adjacent a ceiling surface, said each frame leg having an elongate and linear configuration that is length adjustable so as to be intentionally wedged between the floor surface and the ceiling surface;

a pair of lower support blocks selectively mounted to said pair of frame legs, respectively, at a position upwardly displaced from said distal ends, respectively, and each defining a lower notch having a U-shaped configuration for receiving a lower edge of an easel workpiece;

positioning the lower edge of a respective easel workpiece taken from said plurality of easel workpieces into said pair of lower support blocks so as to receive the indicia on the front face thereof;

providing a holder portion remote from the easel portion, said holder portion including:

a holding plate having a planar configuration and a geometric area that is concentrically larger than a geometric area of said easel workpiece, that holding plate defines a window having a geometric area that is complementary to said geometric area of said easel workpiece, said holding plate including a bottom face portion having a plurality of support rods spaced apart from one another and extending forwardly, said plurality of support rods configured to support said respective easel workpiece thereon;

positioning said respective easel workpiece on said plurality of support rods;

until all of said gathered plurality of said easel workpieces have been positioned on said plurality of support rods, repeating the steps of (a) positioning the lower edge of a respective easel workpiece taken from said plurality of easel workpieces into said pair of lower support blocks and (b) positioning said respective easel workpiece on said plurality of support rods;

wherein said easel portion includes a pair of lower retaining blocks each having opposed end walls and defining a slot extending between said end walls that is configured to receive said lower edge of said easel workpiece and is slidably movable along said lower edge between a locked configuration nested in a respective lower notch and an unlocked configuration displaced from said respective lower notch;

wherein said easel portion includes:

a pair of upper support blocks selectively mounted to said pair of frame legs, respectively, at a position downwardly displaced from said proximal ends, respectively, and each defining an upper notch having an inverted U-shaped configuration for receiving an upper edge of said easel workpiece, and a pair of upper retaining blocks each having opposed end walls and defining a slot extending between said end walls thereof that is configured to receive said upper edge and is slidably movable along said upper edge of said easel workpiece between a locked configuration nested in a respective upper notch and an unlocked configuration displaced from said respective upper notch.

7. The method as in claim 6, further comprising displaying the indicia received on respective front faces of said plurality of workpieces on said plurality of support rods by mounting a light panel rearwardly of said holder portion and energizing said light panel.

8. The method as in claim 6, wherein said pair of frame legs each defines a plurality of through-bores each being spaced apart longitudinally from an adjacent through-bore and having a threaded configuration, said plurality of lower support blocks and said plurality of upper support blocks being selectively mounted to said plurality of through-bores with a fastener.

9. The method as in claim 8 wherein said easel portion includes a plurality of furniture leveler fasteners each having a leg portion threadably mounted to said distal ends of said pair of frame legs, respectively, and a pad portion operative to bear against the floor surface, said plurality of furniture leveler fasteners being operable to lengthen or shorten said pair of furniture legs, respectively.

10. The method as in claim 6, wherein said plurality of easel workpieces are constructed of Plexiglas™.

* * * * *